US005724050A

United States Patent [19]

Tokuda et al.

[11] Patent Number: 5,724,050

[45] Date of Patent: Mar. 3, 1998

[54] LINEAR-CIRCULAR POLARIZER HAVING TAPERED POLARIZATION STRUCTURES

[75] Inventors: Katsuhiko Tokuda, Osaka; Yoshikazu Yoshimura, Takatsuki; Tatsuya Nagatsu, Minou, all of Japan

[73] Assignee: Matsushita Electric Industrial Co., Ltd., Osaka, Japan

[21] Appl. No.: 527,023

[22] Filed: Sep. 12, 1995

[30] Foreign Application Priority Data

Sep. 12, 1994 [JP] Japan ..... 6-217143

[51] Int. Cl.[6] ..... H01P 1/165; H01Q 15/24

[52] U.S. Cl. ..... 343/756; 333/21 A; 333/157

[58] Field of Search ..... 333/21 A, 157; 343/756

[56] References Cited

U.S. PATENT DOCUMENTS

| | | | |
|---|---|---|---|
| 2,546,840 | 3/1951 | Tyrrell | 333/21 A X |
| 3,758,882 | 9/1973 | Mörz | 333/21 A |
| 4,523,160 | 6/1985 | Ploussios | 333/21 A |
| 4,686,537 | 8/1987 | Hidaki | 343/756 X |
| 4,920,351 | 4/1990 | Bartlett et al. | 333/135 X |

FOREIGN PATENT DOCUMENTS

| | | | |
|---|---|---|---|
| 59-108302 | 7/1984 | Japan . | |
| 265701 | 10/1989 | Japan | 333/21 A |
| 131101 | 6/1991 | Japan | 333/21 A |
| 5029801 | 2/1993 | Japan | 333/21 A |
| 2256534 | 12/1992 | United Kingdom | 333/137 |

*Primary Examiner*—Benny T. Lee
*Attorney, Agent, or Firm*—Ratner & Prestia

[57] ABSTRACT

A linear-circular polarizer used for the transmission in the microwave band, which provides excellent impedance characteristics and stabilized cross polarization characteristics by having ¼ wavelength phase plates and the inner surface of a circular waveguide made in one-piece for the purpose of cost and production step reduction. The linear-circular polarizer includes a pair of ¼ wavelength phase plates of a specified width and height formed opposite to each other and symmetric with respect to the waveguides central axis. The ¼ wavelength phase plates are formed on the inner surface of a circular waveguide at a closed end opposite to an end where a primary radiator is located.

8 Claims, 7 Drawing Sheets

LINEAR-CIRCULAR POLARIZER HAVING TAPERED POLARIZATION STRUCTURES

BACKGROUND OF THE INVENTION

The present invention relates to a linear-circular polarizer for receiving electro-magnetic waves in the microwave band used in satellite broadcasting.

In FIG. 13 and FIG. 14, a prior art linear-circular polarizer 70 is shown. FIG. 13 is a front view of the linear-circular polarizer viewed from the opening of the linear-circular polarizer. FIG. 14 is a cross-sectional view of the linear-circular polarizer of FIG. 13 along the line 14—14. The linear-circular polarizer includes a waveguide having a circular hollow shape with a circular wall surface 4 and a ¼ wavelength phase plate 1.

The ¼ wavelength phase plate 1 is made of a metallic material and has a flat trapezoidal shape with a specified sloping surface 1A (shown in FIG. 14) provided at each end. This provides excellent values for both the impedance from a primary radiator 11 towards the phase plate 1 (input impedance) and the impedance from an excitation slot 12 (see FIG. 13) towards the phase plate 1 (output impedance). The phase plate 1 has a specified width (plate thickness) and a flat mounting surface (joining surface shape). This phase plate 1 is attached to the inner surface of circular waveguide 6 (as shown in FIG. 14) at a position which forms an opening angle of 45 degrees from the horizontal axis. Plate 1 is positioned along the axis of the circular waveguide 6 by means of screws 5. Where the phase plate 1 joins the circular waveguide 6, a space exists between the inner surface of the circular waveguide 6 and the surface of phase plate 1. Only the outside edges of the phase plate 1 are in contact with the circular waveguide 6 as shown in a magnified view of the j area where phase plate 1 contacts circular waveguide 6. (See the right section of FIG. 13.) FIG. 10 and FIG. 11 show cross-polarization discrimination characteristics and input impedance characteristics including the characteristics of the linear-circular polarizer shown in FIG. 13 and FIG. 14.

Another prior art example appears in the Utility Model Gazette "Sho 59-108032" of Japan. A linear-circular polarizer comprises four ridges (referred to herein as phase plates) of the same width and height that are disposed on the inner electro-conductive walls of a circular waveguide and arranged 90 degrees apart from one another around the waveguides axis. The flat phase plates are formed of a dielectric material and inserted so as to overlay a pair of the ridges which are symmetric with each other about the waveguides axis. According to this prior art, a circular polarized wave is converted to a linear polarized wave by means of a phase plate formed of a dielectric material. The four ridges are intended for widening the bandwidth characteristics of the waveguide but do not correspond to a linear-circular polarizer.

According to the foregoing prior art structures, the minimum thickness of the phase plate 1 is restricted by the diameter of the mounting screw 5 which makes achieving optimum performance difficult. In addition, the phase plate 1 has sloping sections 1A, thereby making it impossible to remove a male die from the primary radiator side in the course of fabrication and to employ injection molding (aluminum die-cast, for example) as the production method. Therefore, the phase plate 1 has to be attached to the inside of the waveguide 6 as a separate piece.

Further, according to the prior art method, the junction surface of the circular waveguide is concave while the junction surface of the phase plate 1 is flat. This results in an imperfect ground connection due to extremely small contacting areas between the phase plate 1 and the waveguide 6 and a large variation in the mounting position of the phase plate 1.

Consequently, it has been difficult for the prior art structures to achieve excellent impedance characteristics and cross polarization characteristics.

Small errors in the mounting position of the phase plate 1 cause great deterioration in the cross polarization characteristics, thereby making it difficult to achieve stabilized performance. Because of this, frequent correction of the joining position of the phase plate 1 was necessary during mass-production.

SUMMARY OF THE INVENTION

The present invention provides a linear-circular polarizer having a ¼ wavelength phase plate and a circular waveguide integrated in one piece by means of injection molding or the like. The linear-circular polarizer of the present invention has enhanced performance and stabilization.

The present invention uses a single pair of phase plates which are sloping fin shaped and formed opposite to each other on the inner surface of a waveguide at the end opposite the end where a primary radiator is located.

A rectangular shaped separator can be used for enhancing the performance of the linear-circular polarizer. The separator is formed on the inner surface of a closed end of the waveguide situated opposite to the end where a primary radiator is located.

The foregoing phase plate and separator are molded together with the circular waveguide in one piece by means of injection molding or the like.

According to the present invention, the phase plate does not require a separate preparation step, a separate assembly process or a separate adjustment that are needed where the phase plate is made as an independent component. This results in a great reduction of production costs. In addition, cross polarization characteristics and input impedance characteristics of the linear-circular polarizer are improved, thereby contributing to enhancement and stabilization of the performance of the linear-circular polarizer when used as an antenna.

DETAILED DESCRIPTION OF THE INVENTION

Figure 1:
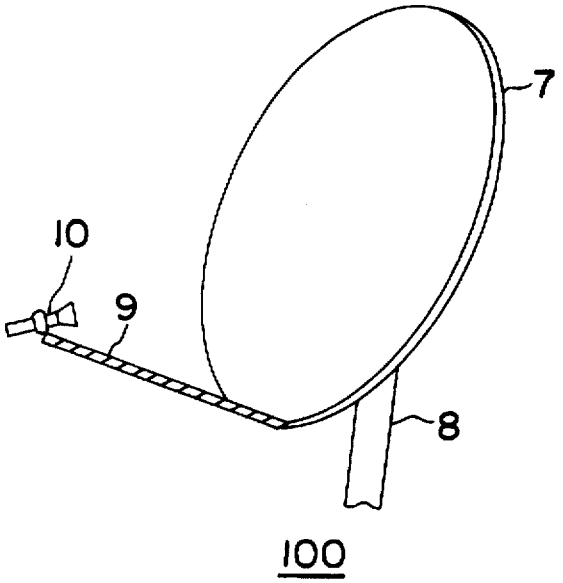
FIG. 1 is a perspective view of the essential parts of a satellite broadcasting receiver using a linear-circular polarizer of the present invention.

Various exemplary embodiments of the present invention will be explained with reference to the drawings wherein like reference numerals refer to like elements throughout.

FIG. 1 is a perspective view of the essential part of a satellite broadcasting receiver 100 wherein a converter 10 incorporating a linear-circular polarizer of the present invention is fixed to a parabolic antenna dish 7 by means of an arm 9. The parabolic antenna dish 7 is mounted on antenna support pillar 8.

The converter 10 comprises a waveguide formed of a linear-circular polarizer and primary radiator, and a converter put together as a single-piece.

EXAMPLE 1

Figure 2:
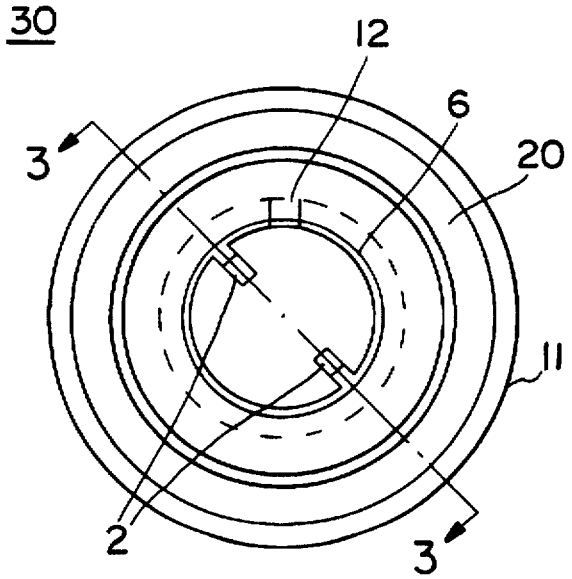
FIG. 2 shows a front view of a linear-circular polarizer in a first exemplary embodiment of the present invention when the linear-circular polarizer is viewed from the open end.
Figure 3:
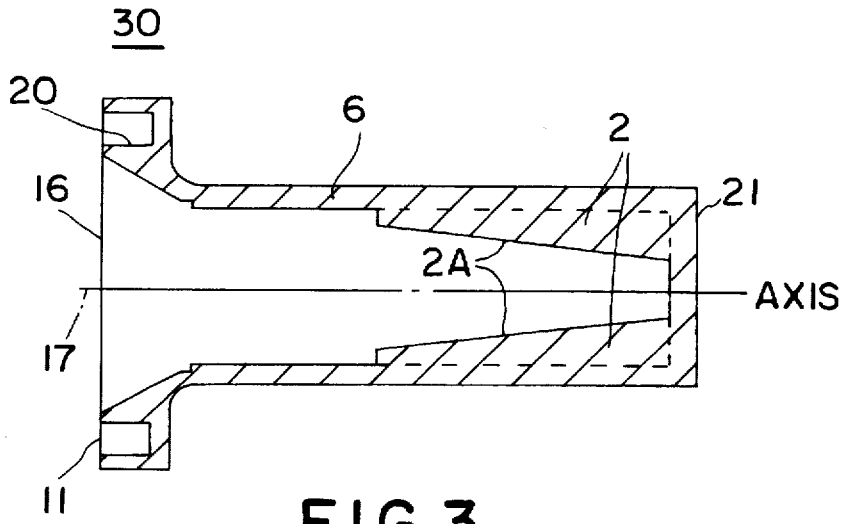
FIG. 3 is a cross-sectional view of the linear-circular polarizer of FIG. 2 taken along line 3—3 in FIG. 2.

FIG. 2 shows a front view of a linear-circular polarizer in a first exemplary embodiment of the present invention when the waveguide making up the converter 10 is viewed from an open end 16 (as shown in FIG. 3).

Figure 4:
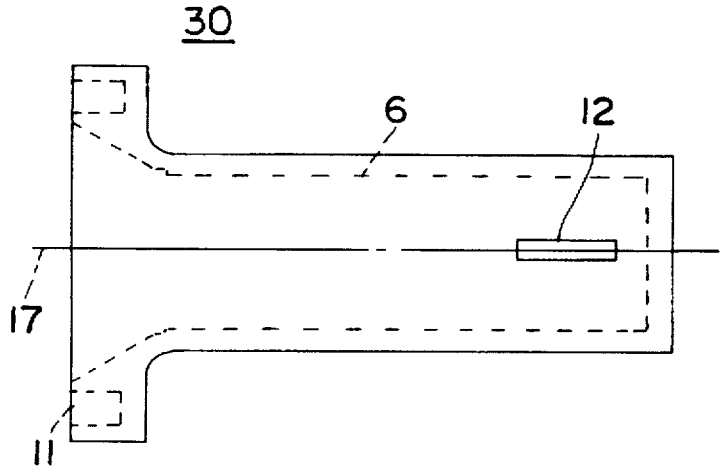
FIG. 4 is a top view of the linear-circular polarizer of FIG. 2.

FIG. 3 is a cross-sectional view of the linear-circular polarizer of FIG. 2 taken along the line 3—3 in FIG. 2. FIG. 4 is a top view of the linear-circular polarizer of FIG. 2.

In FIG. 2 to FIG. 4, the linear-circular polarizer 30 is provided with a primary radiator 11 at one end of a circular waveguide 6, a tapered opening 16 (see FIG. 3) and a corrugated channel 20 (a ring-like depression as shown in FIGS. 2, 3). The other end of the waveguide 6 is closed by a cover 21 (see FIG. 3), and two ¼ wavelength phase plates 2 (see FIGS. 2, 3) are disposed inside of the waveguide 6 symmetric with each other with respect to the axis 17 (see FIGS. 3, 4). The phase plates 2 extend from a specified position on the inner surface of the waveguide 6 to the position where the waveguide 6 is closed by the cover.

As shown in FIG. 2, each ¼ wavelength phase plate 2 is disposed at a position, which makes a specified angle with the vertical axis and the horizontal axis of the waveguide 6 (slanted by 45 degrees in FIG. 2). As shown in FIG. 3, each ¼ wavelength plate 2 has a specified width and height with the height decreasing toward the opening 16 to form a sloping section 2A. Each phase plate 2 resembles a heatsink fin.

Also, as shown in FIG. 2 and FIG. 4, the linear-circular polarizer 30 has an excitation slot 12 for outputting waves formed in the vicinity of the enclosure cover 21 of the circular waveguide 6 in the direction of the vertical axis of waveguide 6.

The slot 12 may be of an arbitrary shape such as a rectangle or an oblong figure and forms an output hole on the circular waveguide 6.

The linear-circular polarizer 30 formed of the primary radiator 11, corrugated circuit 20, ¼ wavelength phase plate 2 and excitation slot 12 is molded into one piece by means of injection molding methods such as diecasting, lost-wax processing or the like, using metallic materials such as aluminum, zinc or the like.

Figure 10:
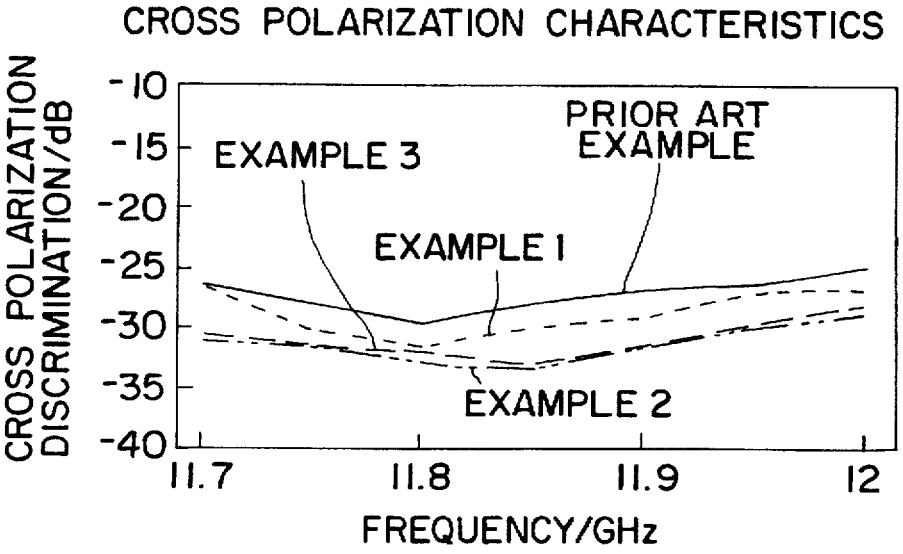
FIG. 10 shows cross polarization characteristics of various exemplary embodiments of the present invention.
Figure 11:
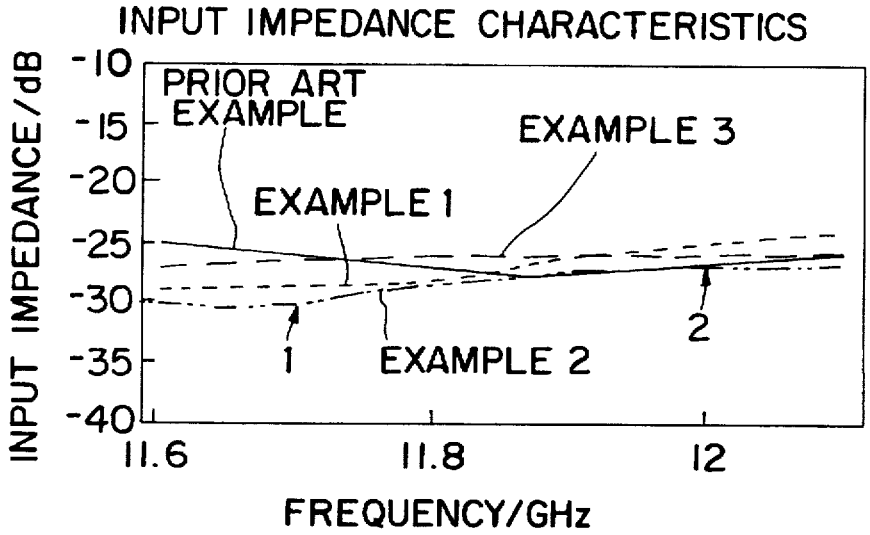
FIG. 11 shows impedance characteristics of various exemplary embodiments of the present invention.

FIG. 10 and FIG. 11 respectively show cross-polarization discrimination characteristics and input impedance characteristics including the characteristics of the linear-circular polarizer 30 of Example 1.

According to the foregoing first example, the linear-circular polarizer 30 of the present invention produces a phase difference equivalent to ¼ wavelength by changing the wavelength inside the waveguide and merging two linear polarization components of a circular polarization wave into one having the same phase, and then outputs it through the excitation slot (12).

EXAMPLE 2

Figure 5:
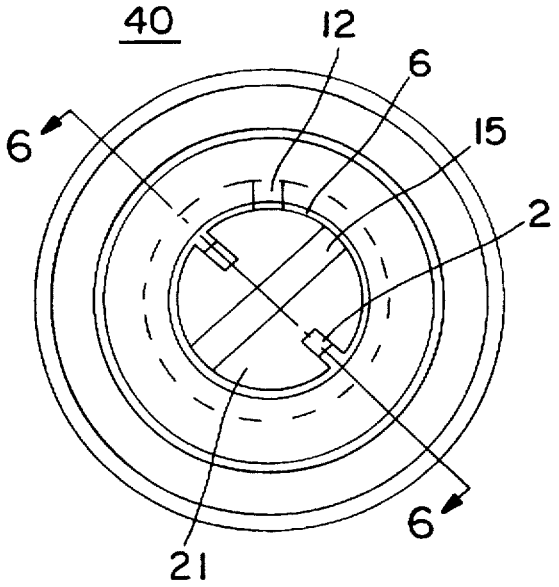
FIG. 5 shows a front view of a linear-circular polarizer in a second exemplary embodiment of the present invention when the linear-circular polarizer is viewed from the open side.

FIG. 5 shows a front view of a linear-circular polarizer 40 in a second exemplary embodiment of the present invention when the linear-circular polarizer is viewed from the open end.

Figure 6:
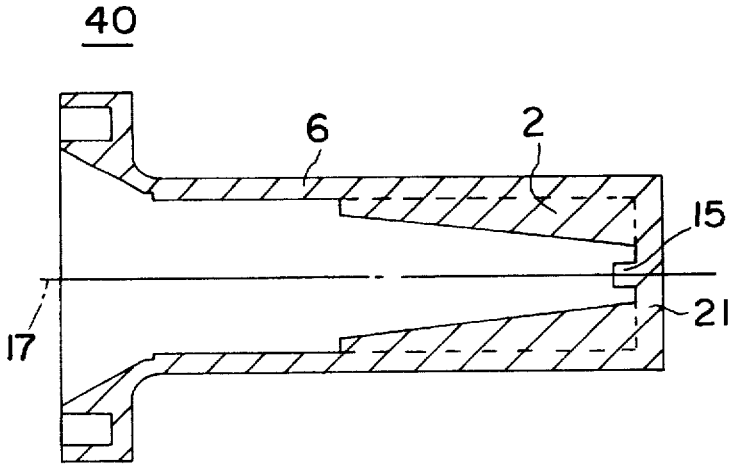
FIG. 6 is a cross-sectional view of the linear-circular polarizer of FIG. 5 taken along line 6—6 in FIG. 5.

FIG. 6 is a cross-sectional view of the linear-circular polarizer 40 of FIG. 5 taken along the line 6—6 in FIG. 5. An axis 17 is shown.

The construction of the linear-circular polarizer 40 of the present example has a rectangular separator 15 of a specified width and height arranged on the inner surface of the enclosure cover 21. An excitation slot 12 is also shown.

As indicated in FIG. 5, the separator 15 is arranged in position to make a right angle with the ¼ wavelength phase plate 2. Separator 15 can also be molded into one piece with the remaining portion of the circular waveguide 6.

As indicated in FIG. 10 and FIG. 11, incorporating this separator 15 with a linear-circular polarizer improves the cross polarization discrimination characteristics and input impedance characteristics when compared with Example 1.

EXAMPLE 3

Figure 7:
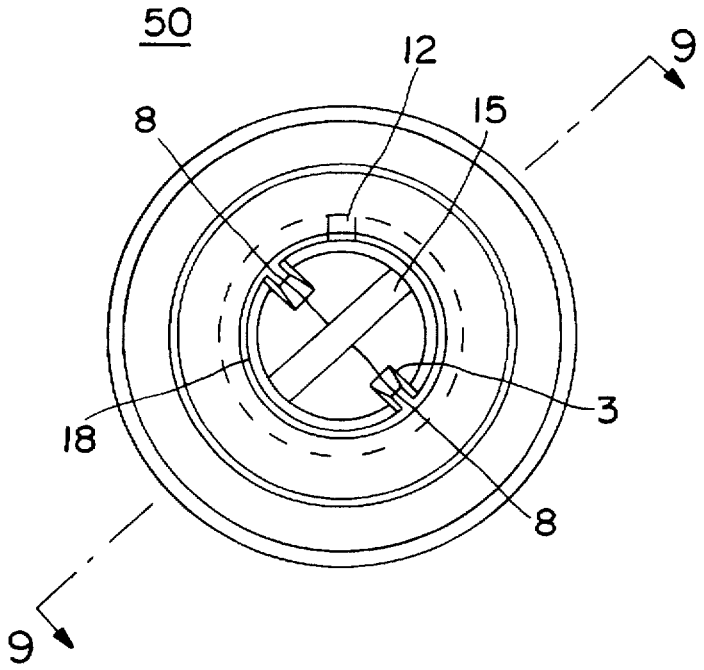
FIG. 7 shows a front view of a linear-circular polarizer in a third exemplary embodiment of the present invention when the linear-circular polarizer is viewed from the open end.
Figure 8:
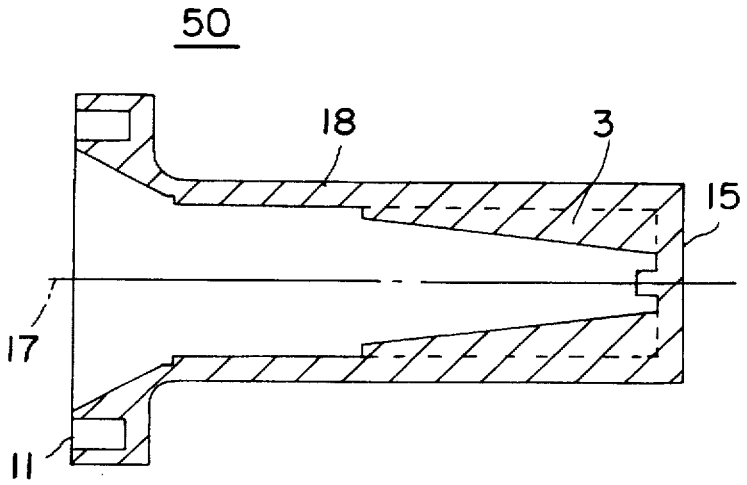
FIG. 8 is a cross-sectional view of the linear-circular polarizer of FIG. 7 taken along line 8—8 in FIG. 7.
Figure 9:
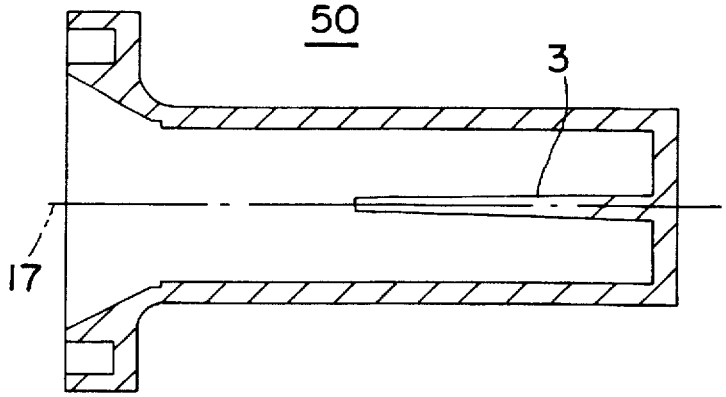
FIG. 9 is a cross-sectional view of the linear-circular polarizer of FIG. 7 taken along line 9—9.

FIG. 7 shows a front view of a linear-circular polarizer in a third exemplary embodiment of the present invention when the linear-circular polarizer 50 is viewed from the opening end. FIG. 8 is a cross-sectional view of the linear-circular polarizer 50 of FIG. 7 taken along the line 8—8 in FIG. 7. FIG. 9 is a cross-sectional view of the linear-circular polarizer 50 of FIG. 7 taken along the line 9—9 in FIG. 7.

In this example, the shape of the phase plate 3 is different from that of the phase plate 2 of Example 2. The width of the phase plate 3 decreases along the axis 17 of the waveguide toward the open end (as shown in FIG. 8). In addition, the height of phase plate 3 decreases along axis 17 of the waveguide (see FIG. 9). Furthermore, the circular waveguide with a tapering surface 18 itself has a tapered shape. These features allow for easy manufacturing through injection molding. An excitation slot 12 and a separator 15 are also shown.

Performance of the linear-circular polarizer 50 of Example 3 is equal to or better than that of the linear-circular polarizer 40 of Example 2 as illustrated in FIG. 10 and FIG. 11.

EXAMPLE 4

Figure 12:
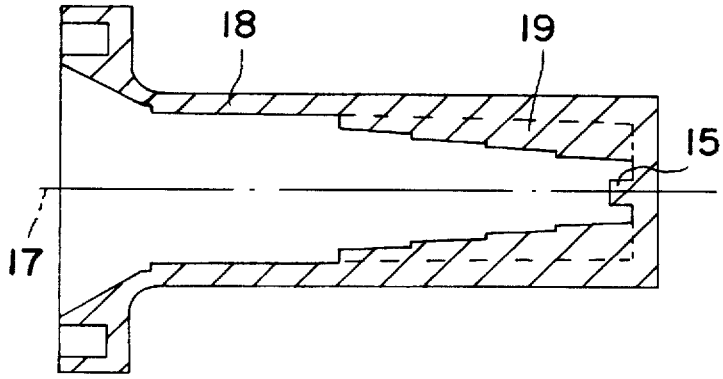
FIG. 12 is a cross-sectional view of a linear-circular polarizer in a fourth exemplary embodiment of the present invention.
Figure 13A:
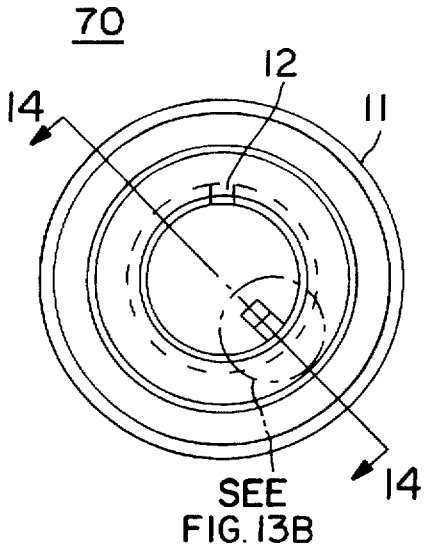
FIG. 13 shows a front view of a prior art linear-circular polarizer when the linear-circular polarizer is viewed from the opening end, and a partially enlarged view of the same.
Figure 13B:
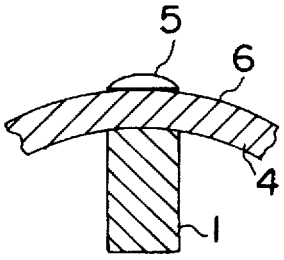

FIG. 12 is a cross-sectional view of a linear-circular polarizer 60 as a fourth exemplary embodiment of the present invention. The present example achieves substantially the same effect as Example 3 by providing the sloping surface of the ¼ wavelength phase plate 19 with a staircase configuration having a specified number of steps, each of which extends over a specified length. An axis 17 is shown. This staircase configuration can also be employed in Example 1 and Example 2. A separator 15 is provided in the circular waveguide with a tapering surface 18.

FIG. 10 shows cross polarization characteristics of the prior art example and exemplary embodiments of the present invention over an input frequency range from 11.7 GHz to 12.0 GHz. The cross polarization characteristics data clearly shows that the examples of the present invention perform better than the prior art version. The improvement in performance is attributed to the ability to select the plate material thickness without being restricted by the diameter of mounting screws required in the prior art example.

Figure 14:
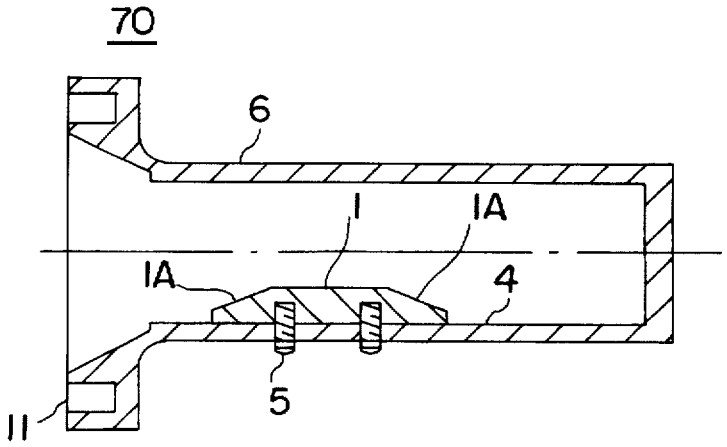
FIG. 14 is a cross-sectional view of the linear-circular polarizer of FIG. 13 taken along the line 14—14 in FIG. 13.

In addition, a matching between a phase plate 1 and an excitation slot 12 is established in the prior art linear-circular polarizer by providing the phase plate 1 with a gently-sloping surface 1A towards the closed end of the waveguide feeder side thereof as shown in FIG. 14. The impedance characteristics of a linear-circular polarizer of the present invention are effectively improved by including a trapezoid shaped separator 15 (see FIG. 12), on the closed end of the waveguide. Further, the shape of the separator 15 affects also the cross polarization characteristics of the linear-circular polarizer, and so both the impedance and the cross polarization characteristics can be optimally adjusted.

Therefore, as indicated in FIG. 10 and FIG. 11, the performance of Example 1 can be improved to that of Example 2 in both the cross polarization characteristics and input impedance characteristics.

Since the performance of Example 3 does not show much difference from that of Example 2 in both the input impedance characteristics and cross polarization characteristics, there is no adverse effect from molding the whole device in one-piece. In FIG. 11, the points indicated by arrows 1 and 2 express the satellite broadcasting (BS) band.

Thus, according to the present invention, the thickness of a phase plate, which in the prior art was restricted by the diameter of mounting screws, can be adjusted for the best performance of a linear-circular polarizer. The ¼ wavelength phase plate is fin shaped and molded into one-piece with the inner surface of a circular waveguide. As a result, the performance of the linear-circular polarizer can be improved.

In addition, since the inner surface of the circular waveguide can be perfectly grounded eliminating the gaps between the circular waveguide and phase plate, variations in the performance of mass-produced linear-circular polarizers due to errors caused during mechanical assembly work are reduced greatly, thereby further contributing to stabilization of the performance of the polarizers.

Further, according to Example 2, the performance of the linear-circular polarizer of Example 1 can be improved by adjusting the width and height of the trapezoid-shaped projection formed on the closed end of the waveguide.

In addition, it is possible to use an injection molding process for the production of the linear-circular polarizer by tapering the circular waveguide and phase plate along the waveguides axis. Consequently, there is no need for any additional processing of the waveguide, or separately preparing and assembling phase plates which treated separate components in the prior art. This results in a cost reduction and enhancement of productivity.

What is claimed:

1. Linear-circular polarizer for receiving a signal having a particular frequency, the linear-circular polarizer comprising a waveguide having a first totally closed end, a second end, and a pair of fin shaped ¼ wavelength phase plates that introduce a phase difference of one quarter cycle of the particular frequency, each of said ¼ wavelength phase plates having a respective sloping surface and situated opposite to each other and on an inner surface of the waveguide so that each respective ¼ wavelength phase plate has one end thereof in contact with the first totally closed end of the waveguide, and said ¼ wavelength phase plates positioned at the first end of the waveguide opposite to the second end of the waveguide where a primary radiator is located so that each respective sloping surface decreases in height along each of the ¼ wavelength phase plates from said closed end of the waveguide to the second end of the waveguide where said primary radiator is located.

2. A linear-circular polarizer according to claim 1, wherein the waveguide has a circular tapered shape.

3. The linear-circular polarizer according to claim 1, wherein a slot is disposed adjacent to the first totally closed end of the waveguide and on the inner surface.

4. The linear-circular polarizer according to claim 1, wherein the respective sloping surface of said each ¼ wavelength phase plate has a staircase-like shape.

5. The linear-circular polarizer according to claim 1, wherein each ¼ wavelength phase plate has a respective tapering surface, said respestive tapering surface decreasing a width of each ¼ wavelength phase plate from said closed end of the waveguide to the second end of the waveguide where said primary radiator is located.

6. The linear-circular polarizer according to claim 1, wherein a rectangular separator is disposed on an inner surface of the closed end of said waveguide.

7. The linear-circular polarizer according to claim 6, wherein said separator is arranged to be oriented at a right angle with respect to said ¼ wavelength phase plates.

8. The linear-circular polarizer according to claim 7, wherein a slot is disposed adjacent to the first totally closed end of the waveguide and on the inner surface.

* * * * *